United States Patent [19]

Cohen

[11] 4,001,895

[45] Jan. 11, 1977

[54] PANELED DIP-COATED WORK GLOVE

[75] Inventor: Neal Ian Cohen, Glenview, Ill.

[73] Assignee: Magid Glove Manufacturing Company, Inc., Chicago, Ill.

[22] Filed: Sept. 4, 1975

[21] Appl. No.: 610,171

[52] U.S. Cl. ..... 2/161 R

[51] Int. Cl.[2] ..... A41D 19/00

[58] Field of Search ..... 2/158, 161 R, 167, 164, 2/163, 161 A

[56] References Cited

UNITED STATES PATENTS

| | | | |
|---|---|---|---|
| 2,004,382 | 6/1935 | Palicki | 2/164 |
| 2,838,759 | 6/1958 | Tassie | 2/167 |
| 3,173,150 | 3/1965 | Mohler | 2/167 |
| 3,363,265 | 1/1968 | Dunmire | 2/167 |
| 3,404,409 | 10/1968 | Tillotson et al. | 2/161 R |
| 3,879,764 | 4/1975 | Weber et al. | 2/167 |

*Primary Examiner*—G. V. Larkin
*Attorney, Agent, or Firm*—Alter and Weiss

[57] ABSTRACT

A paneled, dip-coated work glove for protecting a user's hand from liquid immersible and other work handling applications, having an outer surface layer of plastic material and an inner lining layer.

11 Claims, 5 Drawing Figures

PANELED DIP-COATED WORK GLOVE

BACKGROUND OF THE INVENTION

The present invention relates generally to protective work gloves, and more particularly to plastic material dip-coated work gloves, having a paneled interior lining layer.

Currently, several types of dip-coated work gloves having an exterior surface layer of plastic material and an interior lining layer, are utilized in industrial, commercial and residential applications. The majority of these dip-coated gloves have exterior surface layers comprised of polyvinylchloride, latex, rubber and the like. A glove of this type which is enveloped in a plastic substance, provides several advantages for the user. Among these advantages is the ability to use just such a glove in liquid immersible applications. Covering a glove, for example, with a plastic substance having liquid proof characteristics as most high-molecular weight plastic materials have, imparts a liquid impervious exterior layer so as to protect the user from water, caustic solutions or chemicals in which he must submerge his protected hand. Additionally, several other types of plastic material dip-coated work gloves are utilized, not necessarily to be liquid proof, but also for use in "dry" applications in which firm gripping and dexterity characteristics must be possessed by a glove, and be possessed by a glove, and still yet other applications where a user's hands must be protected. This second type of plastic coated glove is often produced by curing a dip-coated glove to yield many minute perforations into the outer surface so as to provide comfort for the user, while treating the exposed layer of plastic material so as to produce thousands of minute projections on this layer, which assist the user in grabbing and maintaining holds on objects, while improving the dexterity of the glove itself.

The conventional dip-coated work glove, while adequately protecting the user's hands in the applications before mentioned, and while imparting to the user several desired features such as dexterity and grip, still has several drawbacks which the present invention minimizes.

For example, the interior lining layer of a presently used conventional glove is, for the most part, formed by the seaming together, through sewing and stitching, of two lining portions. These two portions are the front portion and the back portion of the interior lining layer. In such a construction, it is inevitable that the bulky stitched seams connecting the front portion to the back portion, run along the sides of the thumb, fingers, palm and back of the hand, and directly contact these portions of the hand and fingers when the user's hand is inserted inside the glove, and throughout the productive use of the glove, producing unnecessary discomfort.

Additionally, the coating of the exterior surface of such a work glove with a plastic substance of high molecular weight, by nature, imparts to the glove a degree of discomfort because of the glove's inability to allow cool air in and its failure to allow a worker's perspiration and heat out. Obviously, if a glove is impervious to liquids on its exterior, it will similarly be liquid proof to the heat and perspiration of the user from the interior. This retention of body heat and perspiration within the glove often produces discomfort for the user.

In many work applications it is necessary, for the comfort of the user similarly, to impart extra depth to a glove. This additional depth improves manipulation, flexibility, and the general comfortability to a user. Quite often, dipcoated work gloves are worn by employees for as much as five to seven hours a day. A glove having extra depth imparted as a characteristic, further allows more exposure of the glove so as to enable the entrance of cooling air into the glove while being used, so as to assist in cooling of the user's hands, as well as the evaporation of the accumulated perspiration previously discussed.

The primary reasons for which the dip-coated work glove is disposed of, replaced and repaired arises out of the substantial usage of the glove and the abrasive wearing of the exterior surface as well as rips and tears associated with such a substantial usage. As previously discussed, the majority of conventional dip-coated work gloves has a tough cord-like seam running from the exterior portion of the thumb along the side of the glove to the exterior side of a user's "pinkie" finger. Thus, the seam can be thought of as dividing the user's hand into a front portion of hand and fingers and into a back portion of hand and fingers. This construction, as mentioned, promotes an unavoidable continuous contact between the surface of the user's hands and fingers and the somewhat bulky seam itself. It is only natural, because of this construction, that a user apply most of his exerted force from his hand and fingers along the seam. Thus, in a majority of situations, a user's hand is against the seam above the hand, and the plastic material coated onto and directly above the seam, comes most often into direct contact with work objects. In such situations, the seam and its associated stitching, place undue force on the plastic material coated directly above them when a user's hand exerts force on work pieces. This has a tendency to cause the plastic material directly above the seams to wear unevenly compared to the plastic material surrounding and enveloping the rest of the glove. Thus, an inordinate amount of wear occurs on the exterior plastic material directly above the seams which are being pushed into the coated material when the glove is used by the user himself. Not only will abrasive wear occur most at these points, but also associated rips and tears have a tendency to occur at these portions of the work glove.

The present invention minimizes these disadvantages associated with a conventional dip-coated worked glove by intentionally utilizing inserted panels in the form of four-chettes and sidewalls so as to move these stitched seams out of contact with the user's hands and thus out of the direction of force of the user's hands. Additionally, the inclusion of separate panels provides additional absorbent material within the glove on the interior surface of the plastic material, so as to improve perspiration absorption from the user's hands and to make the glove more comfortable. Additionally, a paneled section imparts a new dimension of material into the glove itself so as to impart more depth to the glove for manipulation, flexibility, comfort and improved air intake features, and cools the interior of the glove while improving the associated evaporation of perspiration.

Finally, the dip-coated work glove utilizing such a panel feature removes the seams from that direction of force of the user's hand, so as to relocate the seams away from contact with the user's hands when working, and thus prevents abrasive wear on the seam portions as well as the associated rips and tears occuring at these points.

It is thus an object of the present invention to relocate the stitched seam area so as to make a dip-coated work glove more comfortable for its user, and to minimize a user's contact with such seams.

It is additionally an object of the present invention to provide more material for the absorption of a user's perspiration and heat, which is emitted during work operations.

It is further an object of the present invention to impart additional depth to a work glove to improve manipulation, flexibility, comfort, and the air intake characteristics of such a protective article.

Further, it is an object to remove the seam portions of the interior layer of a plastic material-coated work glove so as to keep such seams away from contact when the user of such a glove is exerting force on a work piece, and thus to improve the wearability of such a glove, while minimizing the need to repair, recoat, or replace the glove.

At the same time, it is an object of the invention to provide a method for efficiently fabricating such a glove which possesses the above-identified characteristics.

SUMMARY OF THE INVENTION

The present invention is a dip-coated work glove comprised of at least two specific layers of material. The exterior surface layer is that of a plastic material enveloping a substantial portion of the work glove. The glove additionally has an interior lining layer which directly contacts the hand of the user.

The interior lining layer itself is composed of a front palm portion, a back portion, and one or more extension panel portions. While in one embodiment the front and back portions of the lining are comprised of two separate pieces of material which, in turn, could be folded back over itself. The elements of the interior lining layer are attached into one integral lining through utilization of lining portion attachment means. Further, the interior lining layer and the exterior surface layer are integrally joined together into a one piece work glove by layer attachment means.

One embodiment of the dip-coated work glove involves the utilization of an exterior surface layer of non-porous, high molecular weight plastic substance, which is capable of being dip-coated onto the interior lining layer to form a "liquid-proof" work glove. In such an embodiment, the exterior surface layer is comprised of a substance which itself is impervious to liquids and which envelopes a substantial portion of the work glove, enabling the glove to be immersed in liquid without penetration of said exterior surface layer by the liquid.

Another embodiment of the dip-coated work glove involves the utilization of a similar type of exterior surface layer of plastic material. In this embodiment, the high molecular weight plastic substance which is dip-coated onto the interior lining layer is of such a composition so as to enable further treatment of the exterior plastic substance so as to impart minute porous orifices into said exterior plastic surface, as well as a texture of minute plastic projections on the surface of the plastic material through which additional dexterity, comfort, and elasticity is developed in said work glove.

It should be noted that both embodiments involve the dip-coating of plastic surface material onto an interior lining layer comprised of a front, back, and panel portion in which a substantial portion of the glove, from the user's wrist up to the top of the glove's fingers, is covered with an exterior surface layer of plastic material. Additionally, the interior lining layer in both embodiments is usually composed of a gauzy textile fabric which comfortable surrounds the user's hand and separates if from contact with the exterior surface layer of plastic material.

The extension panel means which, together with the front and back portions of the interior lining layer, integrally form a complete interior lining layer, assist in imparting distinct advantages to the work glove of the present invention. Through the use of the panel extension device, for example, the seams which are utilized to connect portions of the lining can most adequately be placed in a position so as to avoid irritating contact with the user's hands during use of the glove. Additionally, the panel provides supplemental material to assist in the absorption of the user's perspiration and also imparts depth so as to improve, for the user, the glove's manipulation, flexibility and comfort. Relocation of the seams in the interior lining layer themselves further prevents abrasive wear to the glove when, as with a conventional glove, the seam and plastic surface layer directly above said seam is in repetitive contact with the work area. It should be noted that the extension panel device in one embodiment can comprise a fourchette between the front portion and back portion of the interior lining layer so as to cooperate with the front and back portions in forming a finger region in the lining layer of the work glove. In still yet another embodiment, the extension panel device comprises a sidewall between the front portion and the back portion of the lining layer so as to cooperate with these front and back portions to effectively describe a hand region in the interior lining layer of the said work glove. In both these embodiments, however, the panel extension device is attached to the front and back portions via use of lining portion attachment means in which said front, back and extension panel portions are seamed together through stiching and sewing.

The interior lining layer is attached to the exterior surface layer through the use of layer attachment means, which in one particular embodiment, comprises molecular bonding of said exterior surface layer material with said interior lining layer and which is obtained through the dip-coating of the lining layer with the exterior surface plastic material in a liquidized state.

One mode of fabrication for such a dip-coated work glove involves (1) the attaching of the back, front and panel extension portions into an integral lining by seaming these portions together, (2) inserting a hand form into this lining so as to effectively stretch out and expose the surface of said lining, (3) liquidizing the plastic surface material in a container, (4) dipping the formed lining into the container of liquidized plastic so as to immerse a substantial portion of the lining to coat the lining with said plastic, (5) withdrawing the coated glove from the container of plastic material, (6) drying the coated glove, and finally, (7) removing the dried and coated glove from the initially used hand-form device. In the other embodiment previously discussed, the method of fabricating such a glove would also include (1) the curing of the surface of the plastic coated glove after the drying process so as to texturize the glove's plastic outer surface, accompanied by (2) curing the plastic surface so as to place minute orifices in the glove whereby, and as previously mentioned, the glove's elasticity, dexterity and comfortability are improved, though losing its liquid-impervious qualities.

DETAILED DESCRIPTION

Figure 1:
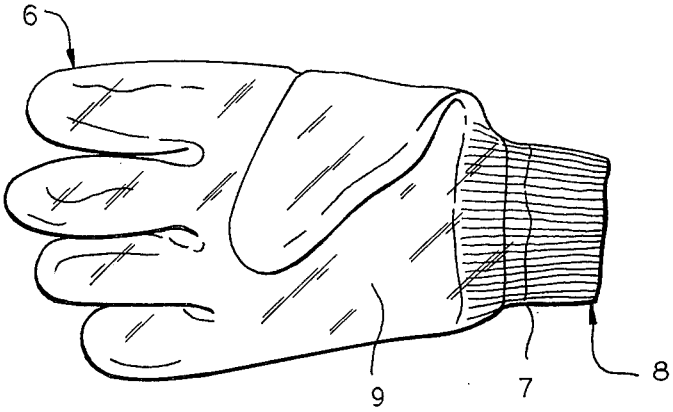
FIG. 1 is a front elevational view of one embodiment of the paneled dip-coated work glove, having a liquid-proof surface.

While this invention is susceptible of embodiment in many different forms, there is shown in the drawings and will herein be described in detail two specific embodiments, with the understanding that the present disclosure is to be considered as an exemplification of the principles of the invention and is not intended to limit the invention to the embodiments illustrated.

The dip-coated work glove 6 of the present invention is shown in FIG. 1 having an exterior surface layer 9 of non-porous plastic material yielding liquid-proof characteristics to the work glove. The preferred embodiment of this invention is dip-coated in a plastic material such as polyvinylchloride or rubber, up through the entire surface area of the glove portion until point 7 on fabric sleeve 8.

Figure 2:
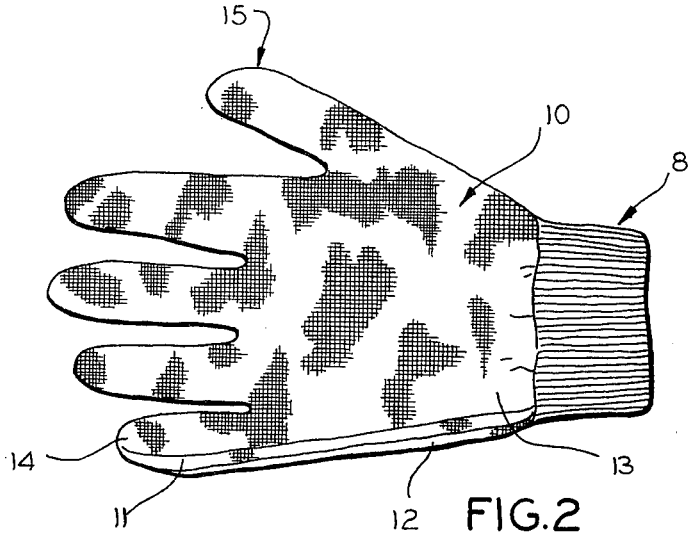
FIG. 2 is a front elevational view of the interior lining layer of the work glove invention showing, particularly, extension panel means.

The interior lining layer 15, as shown in FIG. 2, illustrates the gauzy textile fabric 10 of the interior lining layer 15. Additionally, on the side of smallest finger position 14 is extension panel 11 which, in this particular embodiment, comprises a work glove sidewall. Front portion 13 attaches to sidewall 11 which, in turn, attaches to back portion 12 so as to impart depth to the dip-coated work glove lining, yielding those characteristics previously ennumerated. Extension sleeve 8 is similarly illustrated in FIG. 2.

Figure 3:
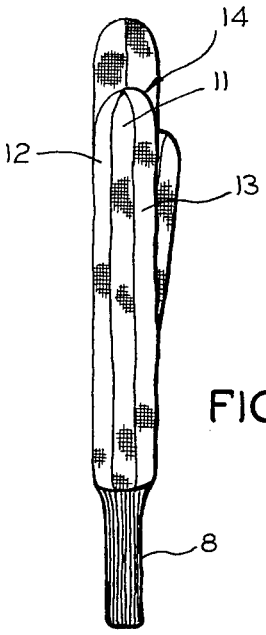
FIG. 3 is a side elevational view of the interior lining layer shown in FIG. 2, particularly displaying the positioning and location of the invention's extension panel means.

FIG. 3 illustrates a side view of the same lining shown in FIG. 2 and, more particularly, denotes smallest finger position 14 formed by back portion 12, sidewall extension panel 11, and front portion 13. Extension sleeve 8, which attaches to one side of the entire front and back portions, as well as panel extension 11, is similarly shown.

Figure 4:
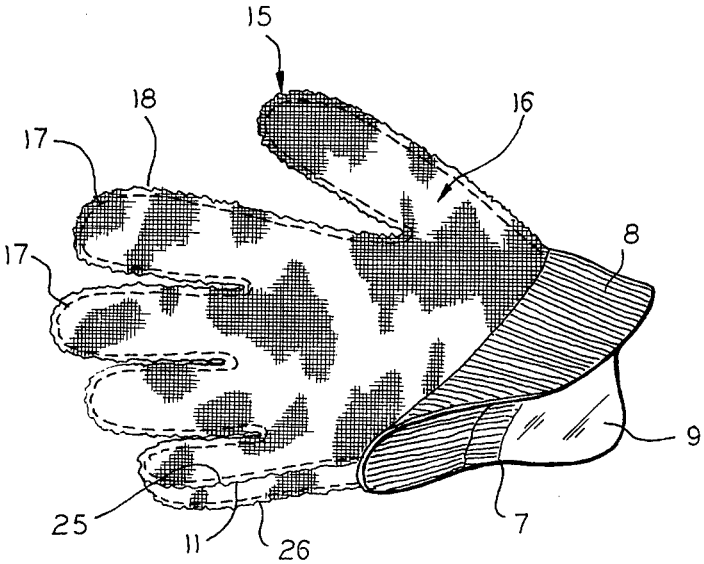
FIG. 4 is a front elevational view of the dip-coated work glove of the present invention in which the work glove has been turned inside out so as to enable viewing of the innermost side of the interior lining layer, as well as a portion of the exterior surface layer of plastic material.

The first embodiment of the dip-coted work glove having a non-porous, liquid-proof exterior surface 9, is shown in FIG. 4, turned inside out so as to illustrate the interior portion 16 of interior lining layer 15. Lining portion attachment means 17 comprising the sewing and stitching of the front and back portions of the interior lining layer, as well as the extension panel means, forms excess overlapped fabric 18, which is the seam surplussage that surrounds all of the stitching and sewing connecting the three main portions of the interior lining layer. These portions, namely portion 25, extension panel extension panel 11 and the back portion (hidden from view) comprise the interior lining layer. Non-porous exterior surface layer 9 is shown in a folded over view extending down to point 7, when dip-coated, on extension sleeve 8. It should be noted that the ragged edges of seam 18, which outline the entire glove and which is further seen through ragged edge 26, is moved away from contact with the user's hand when sidewall panel extension 11 is utilized in the construction of the interior lining layer 15.

Figure 5:
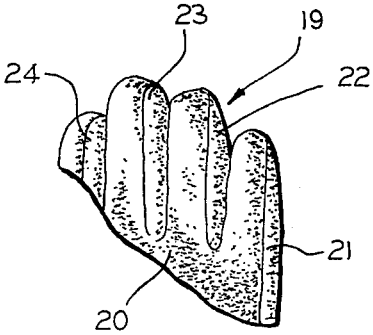
FIG. 5 is a side perspective view of a second embodiment of the invention in which the exterior surface layer of plastic material is porous and textured, and also illustrates the construction and positioning of fourchette-type extension panels.

A second embodiment of the dip-coated work glove is shown in FIG. 5 in which the exterior surface layer 20 of plastic material is cured after dip-coating so as to have a minutely porous surface with substantially increased texture. FIG. 5 additionally shows sidewall extension panel 21, as well as fourchette extension panels 22, 23 and 24. Dip-coated work glove 19, as shown in FIG. 5, while not liquid proof, does impart the characteristics of elasticity, dexterity and comfort which is achieved by its porous and textured surface 20.

The foregoing description and drawings merely explain and illustrate the invention, and the invention is not limited thereto, except insofar as the appended claims are so limited, as those skilled in the arts who have the disclosure before them will be able to make modifications and variations therein without departing from the scope of the invention.

What is claimed is:

1. A dip-coated work glove comprising:

an exterior surface layer of plastic material enveloping a substantial portion of said work glove, an interior lining layer which directly contacts and surrounds a hand upon insertion of said hand into said glove, said interior lining layer having a front portion, a back portion, and extension panel means, said front portion, back portion and extension panel means integrated into one piece by lining portion attachment means, and said interior lining layer and said exterior surface layer integrally joined to one another in a juxtaposed position by layer attachment means.

2. The invention of claim 1 in which said exterior surface layer of plastic material comprises:

a non-porous substantially high molecular weight plastic substance which is capable of being dip-coated onto said interior lining layer so as to form said exterior surface layer, said substance being impervious to liquids and enveloping said substantial portion of said work glove so as to liquid-proof said substantial portion of said glove, whereby said substantial portion of said work glove can be immersed in liquid without penetration of said exterior surface layer by said liquid.

3. The invention of claim 1 in which said exterior surface layer of plastic material comprises:

a substantially high molecular weight plastic substance which is capable of being dip-coated onto said interior lining layer so as to form said exterior surface layer, said substance having such a composition so as to enable treatment of said substance so as to impart minute porous orifices into said substance and impart a texture of minute plastic projections onto the outer surface of said exterior surface layer plastic material whereby additional elasticity, dexterity and comfort is developed in said glove.

4. The invention of claim 1 in which said substantial portion of said work glove which is enveloped by said exterior surface layer comprises the portion of said glove which covers and extends from a wearer's wrist up through the portion of said glove which covers said wearer's fingers.

5. The invention of claim 1 in which said interior lining layer comprises:

a gauzy textile fabric whereby said hand is comfortably separated from contact with said exterior surface layer of plastic material.

6. The invention of claim 1 in which said extension panel means of said interior lining layer further comprises:

at least one sidewall between said front portion and said back portion of said lining layer, said sidewall cooperating with said front portion and said back portion so as to describe a hand region in said lining of said glove, and said sidewall attached to said front portion and said back portion by said lining portion attachment means.

7. The invention of claim 1 in which said lining portion attachment means comprises one or more stitched and sewn seams joining said front portion, said back portion, and said extension panel means into an integral interior lining layer.

8. A dip-coated work glove comprising:

an exterior surface layer of plastic material enveloping a substantial portion of said work glove, an interior lining layer which directly contacts and surrounds a hand upon insertion of said hand into said glove.

said interior lining layer having a front portion, a back portion, and extension panel means, said front portion, back portion and and extension panel means integrated into one piece by lining portion attachment means, said extension panel means comprising at least one fourchette between said front portion and said back portion of said lining layer, said fourchette cooperating with said front portion and said back portion so as to form a finger region in said lining of said glove, said fourchette attached to said front portion and said back portion by said lining portion attachment means, said interior lining layer and said exterior surface layer integrally joined to one another in a juxtaposed position by layer attachment means.

9. The invention of claim 8 in which said extension panel means of said interior lining layer further comprises:

at least one sidewall between said front portion and back portion of said lining layer, said sidewall cooperating with said front portion and said back portion so as to describe a hand region in said lining of said glove, and said sidewall attached to said front portion and said back portion by said lining portion attachment means.

10. The invention of claim 9 in which said lining portion attachment means comprises one or more stitched and sewn seams joining said front portion, said back portion, and said extension panel means into a integral interior lining layer.

11. A dip-coated work glove comprising:

an exterior surface layer of plastic material enveloping a substantial portion of said work glove, an interior lining layer which directly contacts and surrounds a hand upon insertion of said hand into said glove, said interior lining layer having a front portion, a back portion, and extension panel means, said front portion, back portion and and extension panel means integrated into one piece by lining portion attachment means, and said interior lining layer and said exterior surface layer integrally joined to one another in a juxtaposed position by layer attachment means, said layer attachment means comprising a molecular bond between said exterior surface layer material and said interior lining layer.

* * * * *